US008881437B1

(12) United States Patent
McGrath

(10) Patent No.: US 8,881,437 B1
(45) Date of Patent: Nov. 11, 2014

(54) TOY PIECE IDENTIFICATION MARKER SYSTEM

(71) Applicant: Activision Publishing, Inc., Santa Monica, CA (US)

(72) Inventor: David Patrick McGrath, Santa Monica, CA (US)

(73) Assignee: Activision Publishing, Inc., Santa Monica, CA (US)

( * ) Notice: Subject to any disclaimer, the term of this patent is extended or adjusted under 35 U.S.C. 154(b) by 0 days.

(21) Appl. No.: 13/831,528

(22) Filed: Mar. 14, 2013

(51) Int. Cl.
*A44C 3/00* (2006.01)
*G09F 3/16* (2006.01)

(52) U.S. Cl.
CPC .. *G09F 3/16* (2013.01); *A44C 3/001* (2013.01)
USPC ..... 40/1.6; 40/665

(58) Field of Classification Search
USPC ..... 40/586, 633, 665, 304, 658, 1.6; 63/3, 63/11, 40; 446/227, 296
See application file for complete search history.

(56) References Cited

U.S. PATENT DOCUMENTS

| | | | | | |
|---|---|---|---|---|---|
| 1,559,165 | A * | 10/1925 | Hammond | 63/3 |
| 4,936,699 | A * | 6/1990 | Yoshida | 401/48 |
| 5,433,643 | A * | 7/1995 | Pratt | 446/73 |
| 6,047,709 | A * | 4/2000 | Tu | 132/275 |
| 7,313,929 | B2 * | 1/2008 | Lazor | 63/3 |

* cited by examiner

*Primary Examiner* — Joanne Silbermann
(74) *Attorney, Agent, or Firm* — Klein, O'Neill & Singh, LLP

(57) ABSTRACT

One non-limiting embodiment of the present invention includes an identification marker system including a marker base including a coupling member, wherein the coupling member is configured to couple to a toy piece, wherein the coupling member has a default closed position and the coupling member is substantially curved along its length in the closed position, wherein the coupling member has a cross section having a width dimension and a height dimension, wherein the height dimension is substantially larger than the width dimension, wherein the coupling member has an outer surface an inner surface, wherein the inner surface is opposite the outer surface.

11 Claims, 4 Drawing Sheets

TOY PIECE IDENTIFICATION MARKER SYSTEM

TECHNICAL FIELD

The present technology relates to toys and, in particular, identification marker systems for defining ownership or organization of toy pieces.

DESCRIPTION OF THE RELATED TECHNOLOGY

Several toys and games of the household or hobby level incorporate toy pieces. Also, in some games, several toy pieces or teams of toy pieces may be included in game play. In some games, the toy pieces may include other qualities such as identification characteristics, which may include for example, radio frequency identification which provides information to the gaming system through near field communication, and may help identify a player or the player's character of play within the game. Many of these toy pieces are mass-produced, and duplicate copies often appear together in gameplay or general play with the toy pieces.

SUMMARY

The systems, methods and devices described herein have innovative aspects, no single one of which is indispensable or solely responsible for their desirable attributes. Without limiting the scope of the claims, some of the advantageous features will now be summarized.

One aspect of the present invention is the realization that toy pieces and teams of toy pieces can be difficult to identify, especially when used in games with multiple toy pieces, when duplicate toy pieces are present, and when games utilize teams of toys, making the toy pieces easily mistaken for other toy pieces and leading to confusion. Thus, there exists a need for a convenient, customizable, identification system for a variety of toy pieces.

One non-limiting embodiment of the present invention includes an identification marker system including a marker base including a coupling member, wherein the coupling member is configured to couple to a toy piece, wherein the coupling member has a default closed position and the coupling member is substantially curved along its length in the closed position, wherein the coupling member has a cross section having a width dimension and a height dimension, wherein the height dimension is substantially larger than the width dimension, wherein the coupling member has an outer surface an inner surface, wherein the inner surface is opposite the outer surface.

In another non-limiting embodiment, the coupling member comprises a single piece.

In another non-limiting embodiment, the marker base comprises an attachment member affixed to the outer surface of the coupling member, wherein the attachment member is configured to attach a marker charm, wherein the attachment member comprises an attachment face opposite the outer surface of the coupling member, and wherein the attachment face is configured to removably attach a marker charm.

Another non-limiting embodiment includes a marker charm, wherein the marker charm is attached to the attachment member, and the marker charm comprises a visual cue.

In another non-limiting embodiment, the marker charm is interchangeable to provide different marker base and marker charm combinations.

In another non-limiting embodiment the coupling member includes a middle portion, wherein the coupling member includes a first portion protruding from the middle portion in a first direction, wherein the coupling member includes a second portion protruding from the middle portion in a second direction, and wherein the first portion and second portion are configured to wrap around a part of a toy piece.

Another non-limiting embodiment includes a first portion and second portion which overlap when the coupling member is in the closed position.

In another non-limiting embodiment, the first portion and the second portion of the coupling member have a natural tendency to return to the closed position.

In another non-limiting embodiment, the first portion and the second portion may be forced outwards from the closed position to an open position wherein the first portion and the second portion of the coupling member assume a larger radius of curvature in the open position than in the closed position.

In another non-limiting embodiment, the coupling member is configured to couple to a toy piece when released from the open position to the closed position.

In another non-limiting embodiment, the coupling member wraps around a part of a toy piece when released from the open position to the closed position, coupling the marker base to the toy piece.

In another non-limiting embodiment, the first portion comprises a first distal portion at an end of the first portion furthest from the middle portion, wherein the first distal portion is more substantially curved along its length than other portions of the coupling member, such that the first distal portion of the first portion is not adjacent the inner surface of the second portion when the coupling member is in a closed position Another non-limiting embodiment includes an identification marker system including a marker base including a coupling member having a default closed position wherein the coupling member is substantially curved along its length in the closed position, wherein the coupling member includes an outer surface and an inner surface, wherein the inner surface is opposite the outer surface, wherein the marker base includes an attachment member, wherein the attachment member is affixed to the outer surface of the coupling member, wherein the attachment member includes an attachment face opposite the coupling member, a marker charm configured to attach to the attachment face of the attachment member, wherein the marker charm includes a visual cue, wherein the coupling member has a default closed position and the coupling member is substantially curved along its length in the closed position, wherein the coupling member may be forced from the closed position to an open position wherein the coupling member assumes a larger radius of curvature in the open position than in the closed position, and wherein the coupling member is configured to surround a part of a toy piece when the coupling member is released from an open position to a closed position and the inner surface of the coupling member is adjacent the part of the toy piece.

Another non-limiting embodiment includes a toy piece, wherein the toy piece is configured to receive the marker base, such that the marker base can couple to the toy piece.

In another non-limiting embodiment, the marker base and the toy piece have complimentary features configured to couple the marker base to the toy piece.

In another non-limiting embodiment, the coupling member has a natural tendency to return to the closed position.

In another non-limiting embodiment, the coupling member has a cross section having a width dimension and a height dimension, wherein the height dimension is substantially larger than the width dimension.

In another non-limiting embodiment, the coupling member comprises a single piece.

In another non-limiting embodiment, the coupling member comprises a first distal portion, where the first distal portion is more substantially curved along its length than other portions of the coupling member, such that the first distal portion is not adjacent the inner surface of the coupling member when the coupling member is in a closed position.

Another non-limiting embodiment includes a method for defining ownership of toy pieces including providing a marker base, wherein the marker base includes a coupling member having a default closed position wherein the coupling member is substantially curved along its length in the closed position, wherein the coupling member comprises an outer surface and an inner surface, wherein the inner surface is opposite the outer surface, wherein the marker base comprises an attachment member, wherein the attachment member is affixed to the outer surface of the coupling member, wherein the attachment member comprises an attachment face opposite the coupling member, applying a marker charm to the attachment face of the attachment member, wherein the marker charm includes a visual cue, forcing the coupling member into an open position wherein the coupling member assumes a larger radius of curvature in the open position than in the closed position, positioning the inner surface of the coupling member adjacent a part of a toy piece, and releasing the coupling member from the open position, such that the coupling member approaches the closed position while surrounding a part of a toy piece.

In another non-limiting embodiment, the coupling member comprises a single piece having a cross section having a width dimension and a height dimension, wherein the height dimension is substantially larger than the width dimension.

Another non-limiting embodiment of the present invention includes a method of using an identification marker system.

Another non-limiting embodiment of the present invention includes a method of manufacturing an identification marker system.

Another non-limiting embodiment of the present invention includes a means for defining ownership or organization of toy pieces.

Another non-limiting embodiment of the present invention includes an identification marker system including a toy piece.

Another non-limiting embodiment of the present invention includes a toy piece incorporating an identification marker system.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

The above-mentioned aspects, as well as other features, aspects, and advantages of the present technology will now be described in connection with various embodiments, with reference to the accompanying drawings. The illustrated embodiments, however, are merely examples and are not intended to be limiting. Like reference numbers and designations in the various drawings indicate like elements.

DETAILED DESCRIPTION OF THE PREFERRED EMBODIMENT

Figure 1:
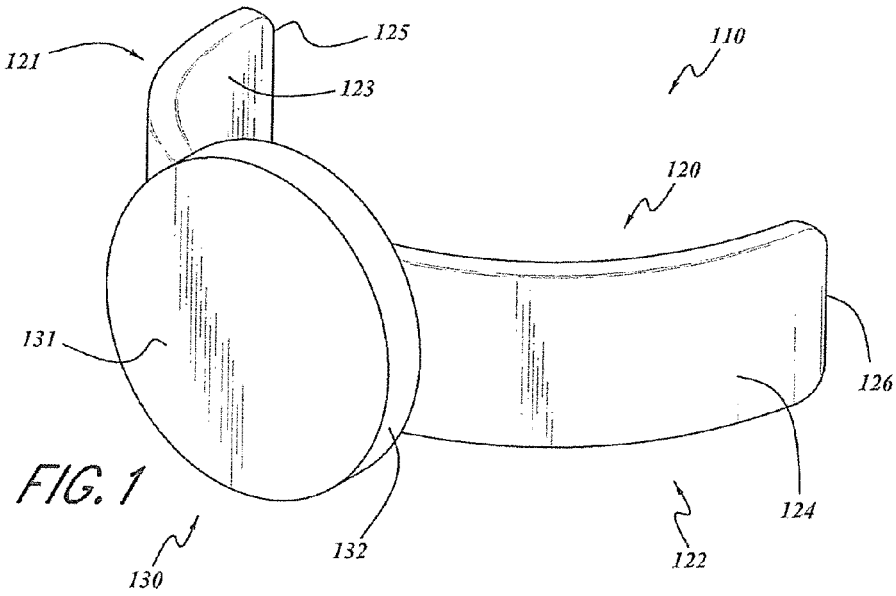
FIG. 1 illustrates a perspective view of one embodiment of a marker base in an open position.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further modifications of the inventive features illustrated herein, and additional applications of the principles of the inventions as illustrated herein, which would occur to one skilled in the relevant art and having possession of this disclosure, are to be considered within the scope of the invention.

Descriptions of unnecessary parts or elements may be omitted for clarity and conciseness, and like reference numerals refer to like elements throughout. In the drawings, the size and thickness of layers and regions may be exaggerated for clarity and convenience.

Features of the present disclosure will become more fully apparent from the following description and appended claims, taken in conjunction with the accompanying drawings. It will be understood these drawings depict only certain embodiments in accordance with the disclosure and, therefore, are not to be considered limiting of its scope; the disclosure will be described with additional specificity and detail through use of the accompanying drawings. An apparatus, system or method according to some of the described embodiments can have several aspects, no single one of which necessarily is solely responsible for the desirable attributes of the apparatus, system or method. After considering this discussion, and particularly after reading the section entitled "Detailed Description of the Preferred Embodiments" one will understand how illustrated features serve to explain certain principles of the present disclosure.

Embodiments described herein generally relate to systems, devices, and methods related to identification marker systems. More specifically, some embodiments relate to identification marker systems that can be used to identify toy pieces, or teams of toy pieces, and tell them apart from other toy pieces, or teams of toy pieces. Toy pieces may include, for example, figurines, characters, human like creatures, army men, miniatures, mythical creatures, animals, machinery, automobiles, remote controlled vehicles, autonomous robotics, biological toy entities, autonomous biological entities, lighter than air toys, aquatic toys, toys made of ice, toys made of food, etc. In some embodiments, the toy pieces may part of a set. In some embodiments, the toy pieces may be sold separately. In some embodiment, the toy pieces are part of an identifiable group of toy pieces which may include, for example, Disney Infinity™ (Disney Interactive Studios Inc., Burbank, Calif.), Skylanders™ (Activision Blizzard Inc., Santa Monica, Calif.), Star Wars™ (Lucasfilm Ltd. Inc., San Francisco, Calif.), Littlest Pet Shop™ (Hasbro Inc., Pawtucket, R.I.), Barbie™ (Mattel Inc., El Segundo, Calif.), toy pieces related to the aforementioned groups of toy pieces, etc.

Some embodiments of the identification marker system provide a customizable system for quickly and conveniently identifying a variety of toy pieces. Some embodiments of the system permit the user or group of users of the toy pieces to avoid confusion by defining ownership and organization of the toy pieces. Some embodiments of the system also allow for differentiation between the toy pieces via unique visual cues between each toy piece's identification marker system, which may include, for example, different colors, different visual images, different emblems, etc. Some embodiments of the system also allow for portions of the system to be interchangeable to allow the user to customize the identification marker system to suit their needs. Some embodiments of the system provide for the identification marker system to couple to a toy piece.

Figure 2A:
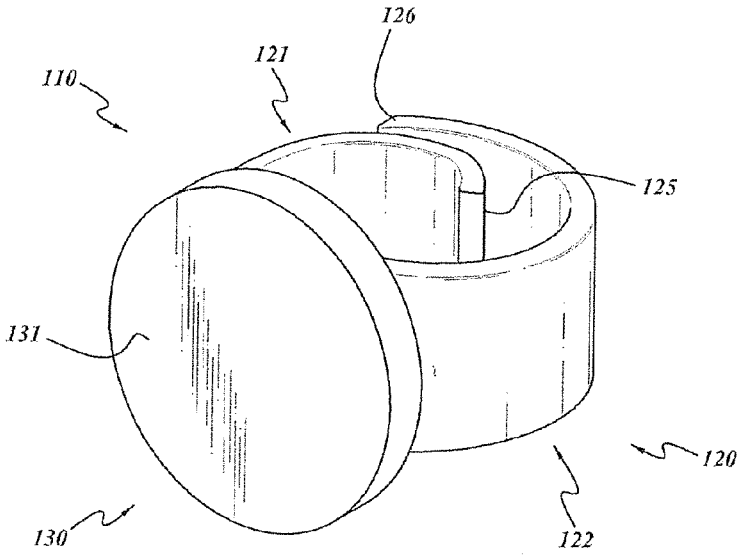
FIG. 2A illustrates a perspective view of one embodiment of a marker base in a closed position.
Figure 2B:
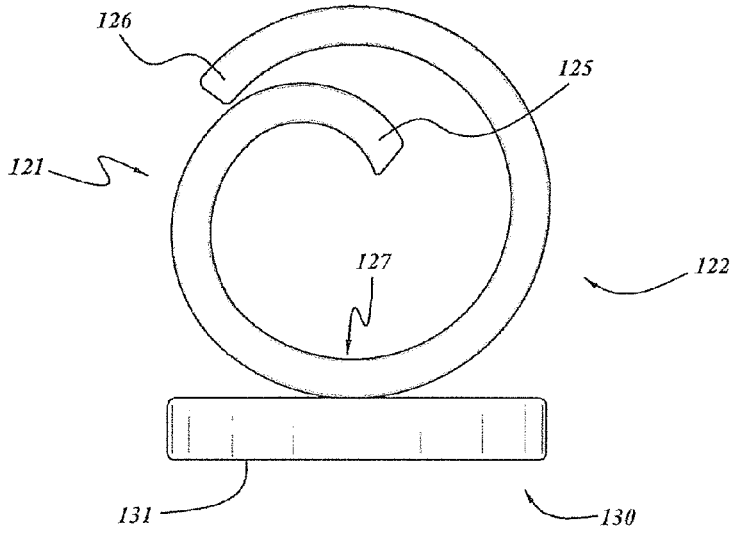
FIG. 2B illustrates a top view of one embodiment of a marker base in a closed position.

FIG. 1 illustrates a perspective view of one embodiment of a marker base 110 in an open position. FIG. 2A illustrates a perspective view of one embodiment of a marker base 110 in a closed position. FIG. 2B illustrates a top view of one embodiment of a marker base 110 in a closed position. In some embodiments, the identification marker system 100 can include a marker base 110. In some embodiments, the marker base 110 can be constructed to couple to a toy piece (not illustrated). The marker base 110 can be constructed so that a user can easily couple and decouple the marker base 110 from the toy piece. In some embodiments, the marker base 110 can include at least one coupling member 120. The coupling member 120 can be constructed to couple to a part of the toy piece. In some embodiments, the coupling member 120 can includes a means for grasping the toy piece. In some embodiment, the coupling member 120 can include a means for wrapping around a part of the toy piece. In some embodiment, the coupling member 120 can include a means for adhesion to the toy piece. In some embodiments, the marker base 110 and the toy piece both include complimentary features configured to couple the marker base 110 to the toy piece. In some embodiments, the coupling member 120 and marker base 110 are constructed such that the system does not scratch or disfigure the toy pieces when coupled to a part of the toy piece.

In some embodiments, as depicted in FIG. 1 and FIG. 2A-2B, the at least one coupling member 120 can be constructed to wrap around a part of a toy piece. In some embodiments, the coupling member 120 can include a first portion 121 and a second portion 122. In some embodiments, the coupling member 120 can include a middle portion 127. In some embodiments, first portion 121 and second portion 122 extend outwards from the middle portion 127. In some embodiments, the first portion 121 and second portion 122 extend outwards from the middle portion 127 in different directions. In some embodiments, the first portion 121 and second portion 122 extend outwards in approximately opposite directions from the middle portion 127. In some embodiments, the first portion 121, second portion 122, and middle portion 127 comprise a single band. In some embodiments, the coupling member 120 is an elongate member. In some embodiments, the coupling member 120 is substantially rectangular in cross section. In some embodiments, the cross section of the coupling member 120 has a height dimension and a width dimension, where the height dimension is substantially larger than the width dimension. In some embodiments, the coupling member 120 is curved along its length. In some embodiments, the coupling member 120 is substantially flat. In some embodiments, the coupling member 120 comprises one single piece of material.

In some embodiments, the marker base 110 can be in an open position as illustrated in FIG. 1. In some embodiments, the marker base 110 can be in a closed position as illustrated in FIG. 2A-2B. In some embodiments, the marker base 110 is constructed so that the default orientation of the coupling member 120 of the marker base 110 is in a closed position. In some embodiments, the first portion 121 and second portion 122 of the coupling member 120 can be substantially curved in a closed position. In some embodiments, the first portion 121 and second portion 122 of the coupling member 120 can be constructed to have a natural tendency to return to a substantially curved closed position. In an open position, the first portion 121 and second portion 122 of the coupling member 120 can assume a larger radius of curvature than when in a closed position. In some embodiments, the coupling member 120 may be constructed in a closed position such that force is required to open the coupling member 120 from a closed position to an open position. In some embodiments, the coupling member 120 may occupy positions in between the open position illustrated in FIG. 1 and the closed position in FIG. 2A-2B.

In other embodiments, the marker base 110 may incorporate other means for retaining the coupling member 120 in a closed position which may include, for example, complimentary hook and loop adhesion systems on adjacent surfaces of the first and second portion 121, 122 of the coupling member 120. In another embodiment, other means for retaining the coupling member 120 in a closed position may include a buckle system which retains the first portion 121 to the second portion 122 in a closed position at a variety of positions along the first or second portion 122 providing a variety of radii formed by the coupling member 120 in a closed position. Another embodiment may include a magnet system incorporating magnetic materials included on or in the first and/or second portion 122 of the coupling member 120 such that the magnets retain the first portion 121 to the second portion 122 in a closed position. In some embodiments, the means for retaining the coupling member 120 in a closed position may include a press snap coupling member 120, wherein at least a portion of the coupling member 120 comprises a curve to its cross section such that it can maintain two default positions, which may include a straight open position and a curved closed position, the default position depending on the orientation of the curve to its cross section which is easily manipulated by the user. Other means for retaining a first portion 121 to a second portion 122 which are known to those skilled in the art are also possible.

In some embodiments, the coupling member 120 is constructed to accept a part of a toy piece when in an open position. In some embodiments, the coupling member 120 includes an inner surface 123 and an outer surface 124. In some embodiments, the first portion 121 and second portion 122 of the coupling member 120 are constructed to move from a closed position to an open position when forced apart by a user. In some embodiments, the first portion 121 and second portion 122 of the coupling member 120 are in a position to allow a part of a toy piece to abut the inner surface 123 of the coupling member 120 when the coupling member 120 is in an open position. In some embodiments, the first portion 121 and the second portion 122 of the coupling member 120 are constructed to return a closed position or a substantially closed position once the user releases the first portion 121 and second portion 122 of the coupling member 120. In some embodiments, the first portion 121 and second portion 122 can wrap around a part of a toy piece once released from an open position and allowed to return to a closed position or a substantially closed position around a part of a toy piece, coupling the marker base 110 to a toy piece. In some embodiments, the first portion 121 and/or second portion 122 will wrap around a part of a toy piece when released from an open position, coupling the marker base 110 to the toy piece and preventing the marker base 110 from falling off of the toy piece. In some embodiments, the natural tendency of the coupling member 120 to return to a closed position will keep the first portion 121 and second portion 122 of the coupling member 120 wrapped around a part of the toy piece, coupling the marker base 110 to the toy piece. In other embodiments, the various means for retaining the coupling member 120 in a closed position discussed above can keep the first portion 121 and second portion 122 of the coupling member 120 wrapped around a part of the toy piece, coupling the marker base 110 to the toy piece. In some embodiments, the coupling member 120 can occupy a variety of positions between the open position and the closed position, allowing the coupling member 120 to couple to a variety of sized toy pieces and portions of toy pieces. In some embodiments, when coupling to a smaller part of a toy piece, the coupling member 120 can wrap around the part of the toy piece and be in a closed or substantially closed position, coupling the marker base 110 to the toy piece. In other situations, when coupling to a larger part of a toy piece, the coupling member 120 can wrap around at least a portion of the part of the toy piece and be in a position between an open position and a closed position, yet still couple the marker base 110 to the part of the toy piece.

In some embodiments, the coupling member 120 wrapping around a part of the toy piece may include a first portion 121 and/or second portion 122 of the coupling member 120 wrapping around at least a part of a toy piece. In some embodiments, a part of a toy piece may include for example, an arm, a leg, a tail, a head, a neck, a waist, a weapon, a tool, etc. In some embodiments the part of the toy piece to which the coupling member 120 of the marker base 110 can couple can be substantially circular. In some embodiments, the first portion 121 and second portion 122 of the coupling member 120 may overlap when in a closed position. In some embodiments, depending on the size of the part of the toy piece to which the marker base 110 is to couple, the first portion 121 and the second portion 122 of the coupling member 120 may overlap when wrapped around the part of the toy piece. In other embodiments, the first portion 121 and the second portion 122 of the coupling member 120 may not overlap. In other embodiments, the part of the toy piece to which the coupling member 120 of the marker base 110 can couple can comprise shapes which are not substantially circular. In some embodiments, the first portion 121 and second portion 122 of the coupling member 120 may not be able to wrap around a portion of the toy member and may have to only grab opposing sides of a part of a toy piece with the first portion 121 and the second portion 122 of the coupling member 120.

In some embodiments, the first portion 121 and second portion 122 each comprise a distal portion 125, 126 located at the ends of the first portion 121 and second portion 122 furthest from the middle portion 127 of the coupling member 120. In some embodiments, the first portion 121 is constructed to curve more substantially then the second portion 122 when in a closed position. In some embodiments, the second portion 122 is constructed to wrap around the outside of the first portion 121 such that the inside surface of the second portion 122 is adjacent the outside surface of the first portion 121. In one embodiment, the first distal portion 125 of the first portion 121 can be constructed to curve more substantially then the rest of the first portion 121, such that the first distal portion 125 of the first portion 121 is not adjacent the inner surface 123 of the second portion 122 when the coupling member 120 is in a closed position. In one embodiment, the more substantially curved first distal portion 125 can provide a surface for the user to contact when forcing the coupling member 120 from a closed position to an open position, easing the process of decoupling the marker base 110 form the toy piece or forcing the coupling member 120 to an open position in order to couple the marker base 110 to a toy piece. In some embodiments, the more substantially curved first distal portion 125 can provide a gripping member for the coupling member 120 to grab onto a part of the toy piece and couple the marker base 110 to the toy piece. In some embodiments, the more substantially curved first distal portion 125 can allow the marker base 110 to fit a wider variety of sizes of toy pieces. The more substantially curved first distal portion 125 can account for portions of toy pieces which are smaller than the inner radius of the coupling member 120 by protruding towards the middle portion 127 of the coupling member 120, allowing the marker base 110 to couple to a smaller part of a toy piece then would otherwise be possible. It is understood that the first portion 121 described herein may be substituted for the second portion 122 and the second portion 122 substituted for the first portion 121.

In some embodiments, as illustrated in FIGS. 1 and 2, the marker base 110 can include an attachment member 130 affixed to the coupling member 120. In one embodiment, the attachment member 130 can be permanently affixed to the coupling member 120. In other embodiments, the attachment member 130 can be removably affixed to the coupling member 120. In one embodiment, the attachment member 130 is affixed to the middle portion 127 of the coupling member 120. In other embodiments, the attachment member 130 can be affixed to the first portion 121 or the second portion 122 of the attachment member 130. In some embodiments, the attachment member 130 is affixed to the outer surface 124 of the coupling member 120. In some embodiments, the attachment member 130 and/or coupling member 120 can incorporate magnets or magnetic materials configured to affix the attachment member 130 to the coupling member 120. In some embodiments, the attachment member 130 and the coupling member 120 can include complimentary hook and loop adhesion systems on adjacent surfaces of the attachment member 130 and coupling member 120. In some embodiments, the attachment member 130 and the coupling member 120 can include complimentary protrusions and recesses on adjacent portions of the attachment member 130 and coupling member 120 providing a means for coupling the attachment member 130 and coupling member 120 via a snap or press fit relationship. In some embodiments the protrusion may include an enlarged portion to snap fit within a complimentary enlarged portion of a recess. In another embodiment, the attachment member 130 and coupling member 120 may include complimentary threaded portions such that the attachment member 130 can be threaded onto and affixed to the coupling member 120. In other embodiments, adhesives may be utilized to attach the attachment member 130 to the coupling member 120 which may include, for example, glue, permanent or reusable stickers, etc. In some embodiments, the attachment member 130 is constructed to serve as a manipulation tool or handle of the identification marker system 100 so that the user can hold and manipulate the system when coupling and decoupling the system to a toy piece.

Figure 3:
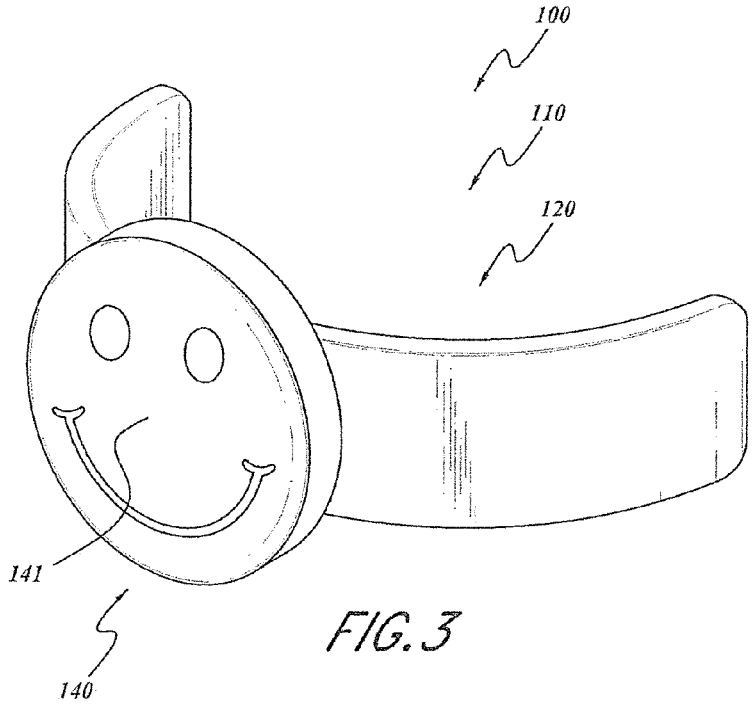
FIG. 3 illustrates a perspective view of one embodiment of an identification marker system in an open position.

In some embodiments, the attachment member 130 includes an attachment face 131. In some embodiments, the attachment member 130 is substantially cylindrical in shape, forming an annular wall 132. In other embodiments, the attachment member 130 can comprise other shapes which may include for example, a square shape, a rectangular shape, a triangular shape, or any shape which complements a marker charm 140 described below. In some embodiments, the attachment member 130 incorporates an attachment face 131 constructed to attach a marker charm 140 as illustrated in FIG. 3. In some embodiments, the attachment face 131 is substantially flat. In other embodiments, the attachment face 131 may incorporate a rougher surface. In some embodiments, the attachment face 131 may incorporate features designed to aid in the attachment of a marker charm 140 to the attachment member 130. In some embodiments, the attachment face 131 is located opposite the outer surface 124 of the coupling member 120.

Figure 4:
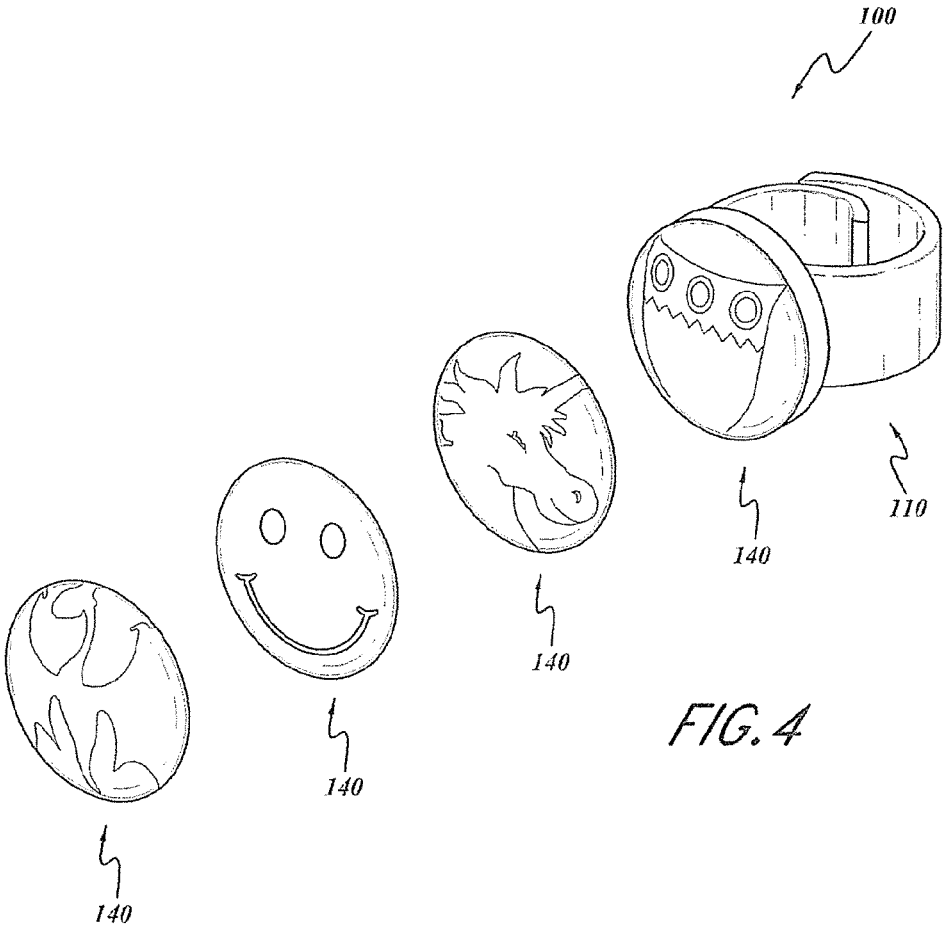
FIG. 4 illustrates a perspective view of one embodiment of an identification marker system in a closed position including additional marker charms.

FIG. 3 illustrates a perspective view of one embodiment of an identification marker system 100 in an open position. FIG. 4 illustrates a perspective view of one embodiment of an identification marker system 100 in a closed position including additional marker charms 140. In some embodiments, the identification marker system 100 includes at least one marker charm 140. In some embodiments, marker charms 140 include a means for identifying and defining ownership or organization of toy pieces. In some embodiments, the marker charms 140 may incorporate unique visual cues 140 which may include, for example, different colors, different visual images, different emblems, etc. By marking each toy piece or each team of toy pieces with a unique visual cue 141, users can differentiate between the toy pieces and teams of toy pieces. In some embodiments, the marker charms 140 can comprise a substantially circular shape. In some embodiments, the marker charm 140 can be constructed to complement the shape and size of the attachment member 130. In some embodiments, the marker charm 140 can have a domed shape.

In some embodiments, the marker charms 140 can be attached to the attachment member 130 of the marker base 110. In some embodiments, the marker charms 140 can be permanently attached to the attachment member 130. In some embodiments, the identification marker system 100 includes a plurality of marker charms 140 as illustrated in FIG. 4. In other embodiments, the marker charms 140 can be removably attached to the attachment member 130, such that a plurality of marker charms 140 including a variety of visual cues 140 could be attached to the marker base 110 interchangeably, allowing the user to customize the identification marker system 100 and identify their toy pieces with their preferred visual cues 140.

In some embodiments, the marker charms 140 may be attached to the attachment member 130 via an adhesive where a portion of the marker charm 140 opposite the portion displaying a visual cue 141 abuts the attachment face 131 of the attachment member 130 and an adhesive is used to attach the marker charm 140 to the attachment member 130 of the marker base 110. Other embodiments may include other means for attaching the marker charm 140 to the marker base 110 which may include for example, a complementary hook and loop adhesion system on adjacent surfaces of the marking charm and attachment member 130, a magnet system incorporating magnetic materials in or on the marking charm and/or attachment member 130, etc. In another embodiment, the identification marker system 100 may include complementary protrusions and recesses on adjacent portions of the marking charm and attachment member 130 providing a means for the marking charm and attachment member 130 to have a snap or press fit relationship. In some embodiments the protrusion may include an enlarged portion to snap fit within a complimentary enlarged portion of a recess. In another embodiment, the marker charm 140 and attachment member 130 may include complementary threaded portions such that the marker charm 140 may be threaded onto and attached to the attachment member 130 of the marker base 110. In other embodiments, adhesives may be utilized to attach a marker charm 140 to the attachment member 130 which may include, glue, permanent or reusable stickers, etc.

Figure 5:
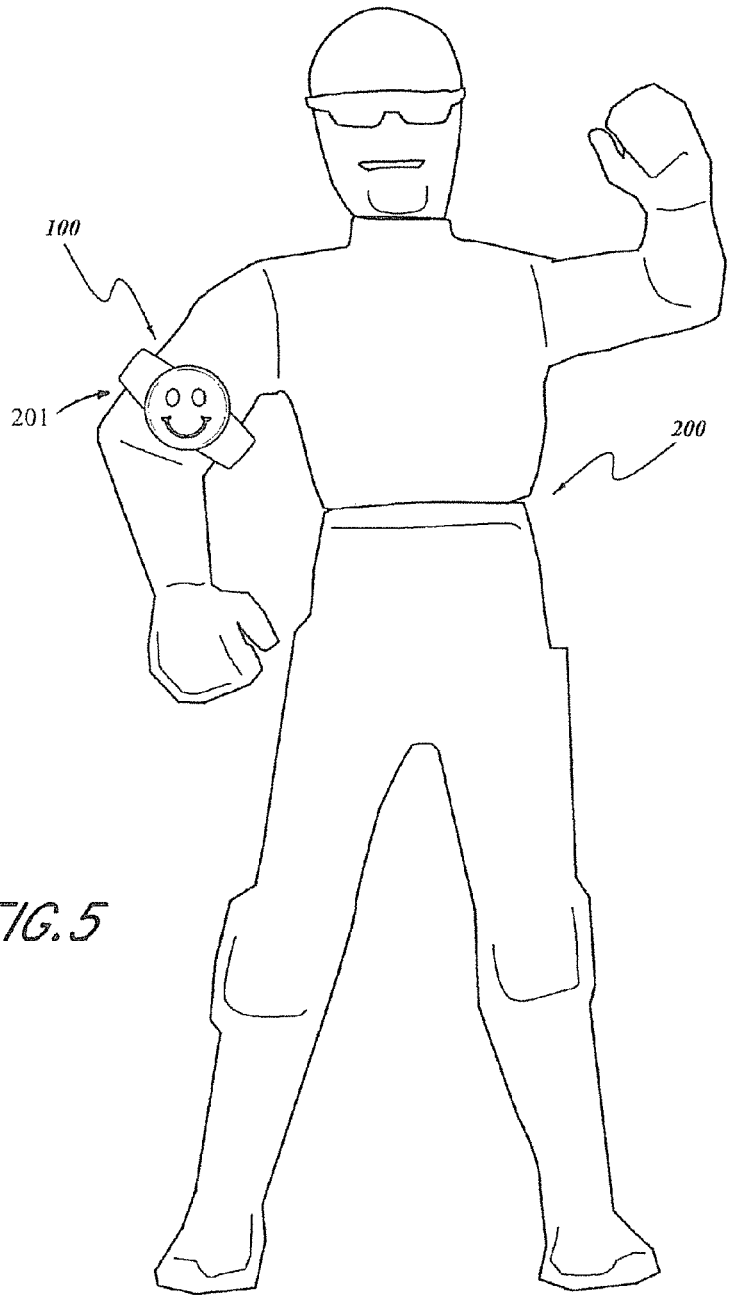
FIG. 5 illustrates a perspective view of one embodiment of an identification marker system coupled to a toy piece.

FIG. 5 illustrates a perspective view of one embodiment of an identification marker system 100 coupled to a toy piece 200. In some embodiments, the identification marker system 100 can include a variety marker bases 110 incorporating a variety of colors. In addition, the identification marker system 100 can include a variety of marker charms 140 incorporating a variety of visual cues 140. Users can attach the marker charm 140 of their choice to the marker base 110 of their choice, creating a large number of potential combinations for identification of a toy piece 200 with the identification marker system 100.

In some embodiments, the marker base 110 and the toy piece 200 both include complimentary features configured to couple the marker base 110 to the toy piece 200. In some embodiments, the marker base 110 is configured to couple to a specific part 201 of a toy piece 200. In some embodiments, a particular part of a toy piece 200 is configured to couple to a marker base 110. In some embodiments, the toy piece 200 and/or the marker base 110 can incorporate magnets or magnetic materials configured to couple the marker base 110 to the toy piece 200. In some embodiments, the toy piece 200 and marker base 110 may include complementary hook and loop adhesion systems on adjacent surfaces of the marker base 110 and the part of the toy piece 200. In some embodiments, the marker base 110 and toy piece 200 can include complementary protrusions and recesses on adjacent portions of the marker base 110 and toy piece 200 providing a means for coupling the marker base 110 via a snap or press fit relationship. In some embodiments the protrusion may include an enlarged portion to snap fit within a complimentary enlarged portion of a recess. In other embodiments, adhesives may be utilized to attach the marker base 110 to the toy piece 200 which may include, for example, glue, permanent or reusable stickers, etc. In some embodiments, the toy piece 200 may incorporate grooves or channels configured to accept and retain the coupling member 120 of the marker base 110. In another embodiment, the marker base 110 and toy piece 200 may incorporate specific biological adhesion in order to couple the marker base 110 to the toy piece 200.

In some embodiments, the marker charms 140 or marker bases 110 can be manufactured from a variety of materials which may include, for example, metals such as aluminum, steel, stainless, steel, spring steel, memory alloys, precious metals, etc. The materials can also include, for example, food products such as dried fruit, edible candy, beef jerky, etc. In other embodiments the materials can include industrial crops such as corn, soy, wheat, etc. Other materials can include minerals such as rocks, gems, soil, or salts. In other embodiments, the materials may include for example, wood, leather, plastic, rubber, thermoplastic, thermoset, acrylonitrile butadiene styrene, polycarbonate alloy, acetal, acrylic, nylon, polybutylene terephthalate, polyester liquid crystal polymer, polypropylene, polycarbonate, polyimide, polythelene, etc. In some embodiments, the materials may be scented. In some embodiments, the scented materials may include for example, a scented polymer. The materials used to manufacture different portions of the identification marker system 100 may include other materials known to those skilled in the art.

In some embodiment, different portions of the identification marker system 100 are made from different materials. In some embodiments, different portions of the identification marker system 100 are produced by different manufacturing processes. Those manufacturing processes may include, for example, injection molding, extrusion, casting, blow molding, thermoforming, rotational molding, foaming, compression molding, transfer molding, machining, three dimensional printing, crystal mineral formation, salt formation, self-assembly by the end user, etc. In some embodiments, multiple manufacturing processes may be utilized to produce the identification marker system 100. In some embodiment, the material may be coated to prevent corrosion and improve the durability of the portion of the identification marker system 100. In some embodiments, coatings or decals can be utilized to change the appearance of different portions of the identification marker system 100.

In some embodiments, the identification marker system 100 can include means for conveying light produced by a light source on or in the toy piece 200 to the identification marker system 100. In some embodiments, the identification marker system 100 can include fiber optic elements configured to convey light produced by a light source on or in the toy piece 200 to the identification marker system 100. In some embodiments, the light conveyed by the identification marker system 100 can be used to help define ownership or organization of toy pieces 200. In some embodiments the visual cues 140 included in the identification marker system 100 may utilize a light source, or light conveying means, to help define ownership or organization of toy pieces 200.

In some embodiments, the identification marker system 100 can include a toy piece. In some embodiments, the identification marker system 100 may be part of a toy piece or incorporated into the toy piece. Some embodiments may include a toy piece marked with the any of the embodiments described herein of the identification marker system 100 or portion of the identification marker system 100 incorporating a visual cue, which may include, for example, a marker charm, a marker base, a coupling member, etc.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. The word "exemplary" is used exclusively herein to mean "serving as an example, instance, or illustration." Any implementation described herein as "exemplary" is not necessarily to be construed as preferred or advantageous over other implementations. Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of the device as implemented.

Certain features that are described in this specification in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

In describing the present technology, the following terminology may have been used: The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims that follow.

What is claimed is:

1. An identification marker system comprising:

a marker base comprising a coupling member;

wherein the coupling member is configured to couple to a toy piece;

wherein the coupling member has a default closed position and the coupling member is substantially curved along its length in the closed position;

wherein the coupling member has a cross section having a width dimension and a height dimension, wherein the height dimension is substantially larger than the width dimension;

wherein the coupling member has an outer surface and an inner surface, wherein the inner surface is opposite the outer surface;

wherein the coupling member comprises a single piece;

wherein the marker base comprises an attachment member affixed to the outer surface of the coupling member;

wherein the attachment member is configured to attach a marker charm;

wherein the coupling member further comprises a middle portion;

wherein the coupling member further comprises a first portion protruding from the middle portion in a first direction;

wherein the coupling member further comprises a second portion protruding from the middle portion in a second direction; and wherein the first portion and second portion are configured to wrap around a part of a toy piece; and wherein the first portion comprises a first distal portion at an end of the first portion furthest from the middle portion, wherein the first distal portion is more substantially curved along its length than other portions of the coupling member, such that the first distal portion of the first portion is not adjacent the inner surface of the second portion when the coupling member is in a closed position.

2. The system of claim 1, wherein the attachment member comprises an attachment face opposite the outer surface of the coupling member, and wherein the attachment face is configured to removably attach a marker charm.

3. The system of claim 2, further comprising a marker charm, wherein the marker charm comprises a visual cue.

4. The system of claim 1, wherein the first portion and the second portion overlap when the coupling member is in the closed position.

5. The system of claim 1, wherein the first portion and the second portion of the coupling member have a natural tendency to return to the closed position.

6. The system of claim 5, wherein the first portion and the second portion may be forced outwards from the closed position to an open position wherein the first portion and the second portion of the coupling member assume a larger radius of curvature in the open position than in the closed position.

7. The system of claim 6, wherein the coupling member is configured to couple to a toy piece when released from the open position to the closed position.

8. The system of claim 7, wherein the coupling member wraps around a part of a toy piece when released from the open position to the closed position, coupling the marker base to the toy piece.

9. An identification marker system comprising:

a marker base comprising a coupling member having a default closed position wherein the coupling member is substantially curved along its length in the closed position;

wherein the coupling member comprises an outer surface and an inner surface, wherein the inner surface is opposite the outer surface;

wherein the marker base comprises an attachment member, wherein the attachment member is affixed to the outer surface of the coupling member;

wherein the attachment member comprises an attachment face opposite the coupling member;

a marker charm configured to attach to the attachment face of the attachment member;

wherein the marker charm includes a visual cue;

wherein the coupling member has a default closed position and the coupling member is substantially curved along its length in the closed position;

wherein the coupling member may be forced from the closed position to an open position wherein the coupling member assumes a larger radius of curvature in the open position than in the closed position;

wherein the coupling member is configured to surround a part of a toy piece when the coupling member is released from an open position to a closed position and the inner surface of the coupling member is adjacent the part of the toy piece;

wherein the coupling member has a cross section having a width dimension and a height dimension, wherein the height dimension is substantially larger than the width dimension;

wherein the coupling member comprises a single piece; and wherein the coupling member comprises a first distal portion, where the first distal portion is more substantially curved along its length than other portions of the coupling member, such that the first distal portion is not adjacent the inner surface of the coupling member when the coupling member is in a closed position.

10. The system of claim 9, further comprising a toy piece, wherein the toy piece is configured to receive the marker base, such that the marker base can couple to the toy piece.

11. The system of claim 9, wherein the coupling member has a natural tendency to return to the closed position.

* * * * *